United States Patent [19]

De Giulio

[11] Patent Number: 5,044,059

[45] Date of Patent: Sep. 3, 1991

[54] METHOD AND APPARATUS FOR RETROFITTING A DRAWER WITH A MULTIPLE LEVEL CUTLERY TRAY OR A CUTLERY TRAY AND CUTTING BOARD

[76] Inventor: John P. De Giulio, 5915 Da Costa, Dearborn Heights, Mich. 48127

[21] Appl. No.: 501,529

[22] Filed: Mar. 30, 1990

Related U.S. Application Data

[63] Continuation-in-part of Ser. No. 344,813, Apr. 28, 1989, Pat. No. 4,993,786.

[51] Int. Cl.[5] ..... B21K 21/16

[52] U.S. Cl. ..... 29/401.1; 312/308; 211/70.7; 211/151; 211/162

[58] Field of Search ..... 29/401.1; 312/298, 301, 312/308; 211/162, 151, 70.7; 403/381

[56] References Cited

U.S. PATENT DOCUMENTS

| | | | |
|---|---|---|---|
| 128,439 | 6/1872 | Unna | 312/301 |
| 362,544 | 5/1887 | Scott et al. | 312/301 |
| 1,061,646 | 5/1913 | Welliver | 312/301 |
| 2,425,232 | 8/1947 | Earle | 62/89 |
| 2,471,529 | 5/1949 | Barre | 312/149 |
| 2,574,099 | 11/1951 | Gessler | 206/75 |
| 2,711,944 | 6/1955 | Meek et al. | 312/333 |
| 2,825,617 | 3/1958 | Morgan | 312/351 |
| 3,278,248 | 10/1966 | Torok | 312/308 |
| 3,554,236 | 1/1971 | Rhodes | 403/381 |
| 4,570,804 | 2/1986 | Meenan | 211/126 |
| 4,895,417 | 1/1990 | Röck | 312/234.5 |

FOREIGN PATENT DOCUMENTS

| | | | |
|---|---|---|---|
| 533985 | 12/1954 | Belgium . | |
| 154291 | 9/1956 | Sweden | 312/301 |
| 269758 | 11/1950 | Switzerland . | |
| 838374 | 6/1960 | United Kingdom . | |

OTHER PUBLICATIONS

Siematic Mobelwerke Product-Photograph and Catalog Page.

Rev-A-Shelf, Inc. Magazine Article.

*Primary Examiner*—P. W. Echols

*Assistant Examiner*—David P. Bryant

*Attorney, Agent, or Firm*—Brooks & Kushman

[57] ABSTRACT

A storage apparatus (10) for converting a standard drawer (12) into a multiple level drawer having a stationary base tray (24) and a shiftable upper tray (26). The base tray (24) is secured to the front of the drawer (12) and includes laterally extending filler flanges (44, 46) on right and left sides of the base tray (24). The upper tray (26) is detachably secured to a support panel (54). Alternatively, a cutting board (82) can be stored on a support panel (54') instead of the upper tray (26). Roller and track assemblies (30, 32) interconnect the support panel (54) of the upper tray (26) to the base tray (24). The upper tray (26) is shifted until it extends through an opening (76) formed in the rear wall (18) of the drawer (12). The roller and track assembly (30, 32) preferably includes channels (60) secured to the upstanding walls (34, 36) of the bottom tray (24) and bearing members (62) secured to the channels (60). According to the method of the present invention, the storage apparatus is retrofitted to a standard drawer which is modified by removing a cut-out from the rear wall of the drawer. The base tray (24) is secured to the modified drawer and the upper tray (26) is attached for horizontal shifting to the base tray (24). The method also includes molding the base tray (24) and upper tray (26).

5 Claims, 3 Drawing Sheets

METHOD AND APPARATUS FOR RETROFITTING A DRAWER WITH A MULTIPLE LEVEL CUTLERY TRAY OR A CUTLERY TRAY AND CUTTING BOARD

TECHNICAL FIELD

This is a continuation-in-part application of U.S. Ser. No. 344,813, Filed Apr. 28, 1989, now U.S. Pat. No. 4,993,786.

The present invention relates to a compartmentalized storage device for kitchen utensils or other small articles stored in drawers. More particularly, the present invention relates to a kit for converting a standard drawer into a double drawer having two storage trays, one of which is shiftable relative to the other storage tray. A removable cutting board may be stored by the device in place of the shiftable storage tray.

BACKGROUND

Kitchen utensils, medical supplies, dental tools and other small articles are stored in special partitioned drawers which permit separation of small articles while stored in the drawer. In many instances, it is desirable to increase the number of compartments within a drawer.

Molded utensil trays having compartments for kitchen utensils or other small objects are conventionally placed loosely in the bottom of a drawer. In some instances, it is desirable to have even more compartments to increase the available number of compartmentalized storage sections in a drawer.

One approach to this problem is shown in a product catalog published by SieMatic Mobelwerke GmbH & Co. (SieMatic) at page 77, wherein two utensil trays are assembled to a multi-part plastic drawer assembly which is adapted to be installed as a drawer of a predetermined width. A drawer roller guide supports the upper tray on its sides between the sides of the drawer. The specialized drawer has a slidable tray which is mounted by the roller guides to the sides of the drawer. The SieMatic drawer is well suited for drawers of new cabinet systems, but it is impossible to retrofit to existing drawers due to the difficulty of fitting the drawer to the sides of drawers having various widths. In addition, the SieMatic drawer has a wooden base support and side braces that require substantial assembly. The SieMatic drawer is built around a primary molded pan in which the base tray is inserted and supporting structural members for the upper tray are assembled. The molded pan is of predetermined dimensions and provides no means of fitting the device to different width drawers.

The SieMatic device is not intended to be retrofitted into different width drawers as would be essential to a simple and effective retrofit kit.

Another problem addressed by the present invention is conveniently and accessibly storing a relatively large cutting board without taking up valuable counter space. Cutting boards, if built into a counter, are troublesome to clean and keep in a sanitary condition. Large cutting boards are difficult to store in a drawer because they either cover other objects stored in the drawer or are covered by such objects. Likewise, if a cutting board is stored on a shelf, other objects would normally be stacked on the shelf or it can be inconveniently stored on edge in a cupboard. All of these alternatives fall short in terms of accessiblity.

It is an object of the present invention to provide a multiple level compartmentalized storage tray which is suitable for retrofit to a wide range of drawer sizes.

Another object of the present invention is to provide a multiple level storage tray having an upper storage tray which is easily slidable in drawer guides between a closed position above a base tray slide and an open position wherein the upper tray slide is cantilevered through an opening in the back wall of the drawer.

An object of the present invention is to provide a multiple tiered drawer insert kit for retrofit in a standard drawer to increase the storage capacity of the drawer which is not difficult to install and does not require specialized tools for installation.

Another object of the present invention is to provide a two-tiered compartmentalized storage tray having an upper storage tray which is biased to the closed position as the drawer is opened.

An object of an alternative embodiment of the present invention is to provide a storage mechanism for a cutting board which is associated with a cutlery storage device. The cutting board is conveniently stored with cutlery implements but does not interface unduly with access to the cutlery stored below the cutting board. The cutting board is stored on a shiftable support panel that allows the cutting board to be rolled out of the way when access to cutlery implements stored in the base tray is desired.

Another object of the alternative embodiment is to provide a cutting board that is removable from the storage location for use in any location and for cleaning in a dishwasher.

These and other problems and disadvantages are overcome and the above objects are achieved by the present invention as will be more fully described below.

SUMMARY OF THE INVENTION

The present invention relates to a retrofit storage apparatus for a drawer wherein a base tray is secured to the drawer and an upper tray is shiftably mounted above the base tray. Two lateral wings each spanning the spaces between one side of the upper tray and a sidewall. The lateral wings are longitudinally trimmable to fit a predetermined range of drawer widths. The upper tray and base tray are relatively shiftable to each other on means for guiding the horizontal shifting of the upper tray.

More particularly, the present invention relates to a two-tiered storage apparatus for retrofit to a conventional drawer. The storage apparatus includes a base tray having a compartmentalized storage section. A lip extends substantially horizontally and outwardly from the compartmentalized storage section. The lip has an outer edge located at a distance from the compartmentalized storage section from which a vertical wall extends upwardly. Lateral trim flanges are connected to an upper edge of the vertical wall to extend substantially horizontally and outwardly and are cut to fit the side walls of the drawer. An upper tray is disposed above the base tray and includes a support panel. A compartmentalized storage receptacle is detachably secured to the support panel. A roller track means is connected to the upper tray and the base tray for guiding the horizontal shifting movement of the upper tray from a closed position in which the upper tray is vertically directly above the base tray to an open position in which the upper tray is cantilevered by the roller track means rearwardly and above the base tray. In the open position, the upper tray extends horizontally through the cutout and partially behind the rear wall of the drawer.

The invention also comprehends a storage apparatus for a drawer having a cutout section in the upper portion of the rear wall of the drawer wherein the storage apparatus includes a base tray fixedly secured to the drawer, and an associated upper tray shiftable mounted above the base tray. First and second lateral flanges extend between the upper tray and one of the sidewalls. The first and second lateral flanges are intended to be trimmed longitudinally to fit a range of drawer widths so as to be fitted to the first and second sidewalls. First and second guide means are fixedly secured relative to the drawer for guiding the shifting movement of the upper tray relative to the base tray. The guide means and first and second lateral flanges are located between the first and second sidewalls of the drawer and the upper tray so that the first and second lateral flanges may be trimmed to change the width of the storage apparatus so as to fit within the drawer without necessitating any alteration of the upper tray.

Another aspect of the invention is the provision of a two-tiered cutlery storage apparatus that is adapted to be supported in a cabinet drawer defining an open top cavity movable between open and closed positions. The two-tiered cutlery storage apparatus comprises a base tray secured to the cabinet drawer and configured to receive cutlery utensils in separate compartments. An upper tray molded to standardized dimensions has first and second side edges which are connected to flange means. The flange means function to fill between the first and second side edges and the sides of the drawer. The rear wall of the drawer has a cutout formed in an upper portion to provide clearance for movement of the upper tray through the plane of the rear wall of the cabinet drawer when the drawer is in the open position and the tray is in the cavity formed by the drawer. The sides of the drawer may be spaced apart within a range of dimensions as defined by the trimmable variable width of the flange means plus the width of the upper tray.

An important aspect of the storage apparatus of the present invention relates to the concept of providing trim flanges on the lateral sides of the compartmentalized storage section of the lower tray. The trim flanges fill between the compartmentalized storage section and the side walls of the drawer and are trimmed to fit a given drawer width. The compartmentalized storage receptacle is preferably detachably secured to the support panel so that it may be removed for cleaning or for carrying as a tray.

The upper and base trays are interconnected by means of roller and track assemblies connected to adjacent portions of the upper tray and base tray. A pair of roller and track assemblies are preferably provided with a pair of base tray channels being secured to each lateral side of the base tray. The base tray channels each include a first bearing member at the rear thereof. A pair of upper tray channels are secured on each lateral side of the upper tray. Each upper tray channel has a second bearing member located at the front end of the channel. The bearing members ride upon a roller engaging surface of the channel to which it is not connected.

The roller engaging surfaces of the upper tray channels preferably include raised sections which bias the upper tray into the closed position as the drawer is opened. After opening, the upper tray may be easily moved past the raised section to have access to the lower tray compartmentalized storage section.

The present invention relates to a two-tiered cutlery storage apparatus which is adapted to be dropped into a cabinet drawer having front, side, rear and bottom walls defining an open top cavity. The two-tiered cutlery storage apparatus comprises a base tray secured to the cabinet drawer which is configured to receive cutlery utensils in separate compartments. An upper tray molded to standardized dimensions is provided and includes first and second side edges. Support means are provided for supporting the upper tray in a shiftable relationship to be shiftable toward or away from the front wall of the drawer with the upper tray being shiftable relative to the base tray. The rear wall of the drawer has a cut out formed in an upper portion to provide clearance for movement of the upper tray through the plane of the rear wall of the cabinet drawer when the drawer is in the open position and the tray is in the cavity formed by the drawer. Filler means are provided between one or both of the side edges of the upper tray and the sidewalls of the drawer to fit the apparatus to the sides of the drawer. The sides of the drawer are spaced apart within a range of dimensions as defined by the filler means and the width dimension of the upper tray.

According to another aspect of an alternative embodiment of the present invention, a storage apparatus for a drawer is provided wherein a drawer having a bottom, front, rear and two sidewalls is provided. The rear wall of the drawer has a cut out section in its upper portion. The storage apparatus includes a base tray secured in a fixed relationship to the drawer, a detachable cutting board disposed above the base tray and means interconnecting the cutting board to the base tray for horizontally shifting the cutting board. The cutting board shifts from a closed position in which the cutting board is above the base tray to an open position in which the cutting board is cantilevered rearwardly and above the base tray to extend horizontally through the cut out in the rear wall and partially behind the rear wall of the drawer.

Instead of providing a second compartmental storage receptacle which is detachably secured to the support panel, a cutting board may be stored on the support panel. The cutting board is removed from the cutlery tray for use and cleaning. The cutting board is preferably formed of a polyethylene material, and includes dados, or grooves, on the upper and lower surfaces of the front and rear portions of the cutting board. The dados are adapted to receive upstanding flanges on the support panel which hold the cutting board in place and prevent front to rear shifting of the cutting board when the drawer is opened or when the support panel is shifted toward and away from the front of the drawer.

The cutting board is conveniently stored above the cutlery utensils in the base tray and can be easily rolled out of the way to provide access to the cutlery utensils. It is not necessary to remove the cutting board from the cutlery tray to have access to the cutlery utensils. Further, the cutting board does not tend to become covered by other objects stored in the drawer because it is located above a compartmentalized storage area.

The method of the invention is broadly viewed as a method of retrofitting a drawer with a two-tiered storage apparatus. The method includes the steps of cutting out an upper portion of a rear wall of the drawer to form an opening in the rear wall. A base tray is placed in a drawer and a stationary part of first and second guide means is mounted in a drawer. The stationary part of the guide means may or may not be part of the base tray. An upper tray is attached by a shiftable part of the first and second guide means to the stationary part of the guide means so that the upper tray is horizontally shiftable between a closed position and an open position. In the open position, the upper tray is partially extended through the opening in the rear wall of the drawer and is cantilevered over the rear wall.

The method of the present invention relates to retrofitting a conventional drawer with a two-tiered compartmentalized storage tray. The method includes the steps of removing an upper portion of a rear wall of the drawer to form an opening in the rear wall. A base tray having a first part of a track and roller assembly is secured to the drawer by fastening means. An upper tray is then attached by a second part of the track and roller assembly to the first part of the track and roller assembly retained on the base tray. The upper tray is then horizontally shiftable and guided by the track and roller assembly between a closed position and an open position.

Another aspect of the method of the present invention is the step of attaching a compartmentalized storage section to a support panel. The support panel is preferably first attached to the base tray before the assembly of the compartmentalized storage section to the support panel.

According to the method of the present invention, the base tray is first molded in one piece. A first part of the track roller assembly is then secured to the molded base tray. The compartmentalized storage section of the upper tray is likewise molded in one piece. The second part of the track and roller assembly is then secured to the support panel.

The method of retrofitting a drawer with a two-tiered storage apparatus may also be implemented by providing such a storage apparatus in an open top drawer. The steps of the method include cutting out an upper portion of the rear wall of the drawer to form an opening in the rear wall. A base tray is then placed in the drawer. A stationary part of the first and second guide means is also mounted in the drawer. The method is completed by attaching an upper tray having a shiftable part of the first and second guide means to the stationary part of the first and second guide means. The upper tray is then horizontally shiftable between a closed position and an open position in which the upper tray is partially extended through the opening in the rear wall of the drawer and cantilevered over the rear wall.

According to the method of retrofitting a drawer with a two-tiered storage apparatus described above, the method may also include the step of attaching a detachable cutting board to the upper tray to be shiftable with the upper tray or removed from the upper tray for use as a cutting board separate from the upper tray. The cutting board preferably includes a groove which receives a flange of the upper tray to prevent sliding displacement of the cutting board relative to the upper tray during horizontal shifting movement of the upper tray. The upper tray may also include a flange at its rear edge which engages an edge of the cutting board to prevent sliding movement of the cutting board during horizontal shifting of the upper tray.

The present invention will be more fully described below in reference to the attached drawing.

DETAILED DESCRIPTION

Figure 1:
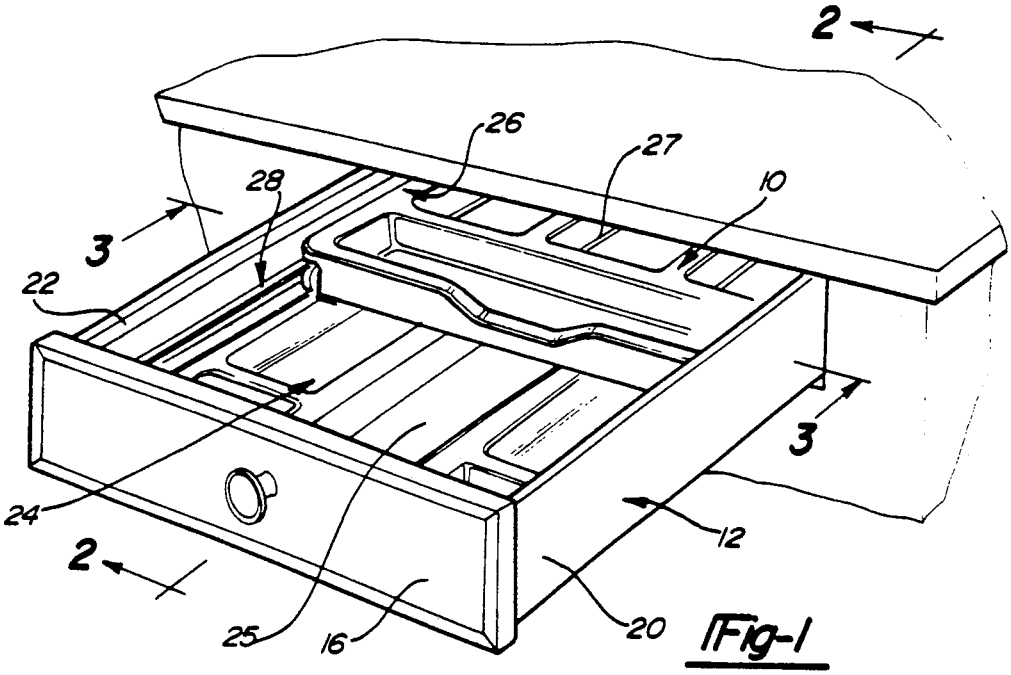
FIG. 1 is a perspective view of a drawer retrofitted with the storage apparatus of the present invention.

Referring now to FIG. 1, the storage apparatus 10 of the present invention is shown installed in a drawer 12. The drawer 12 is of conventional design having a bottom 14, front wall 16, rear wall 18 and right and left side walls 20 and 22. A base tray 24 having a compartmentalized storage section 25 is connected to an upper tray 26 defining a compartmentalized storage section 27 by a guide means generally indicated by the arrow 28.

The base tray 24 and upper tray 26 are preferably vacuum formed in one piece from a thermoplastic polymer such as polypropylene or polyvinylchloride. The guide means 28 are preferably roller track assemblies of the type normally used to mount a drawer in a cabinet. Right and left roller track assemblies 30 and 32 are better shown in FIGS. 2 and 3. They are preferably secured to the upper and base tray in a reverse orientation relative to the normal orientation of drawer roller track assemblies used to attach a drawer to a cabinet.

Figure 2:
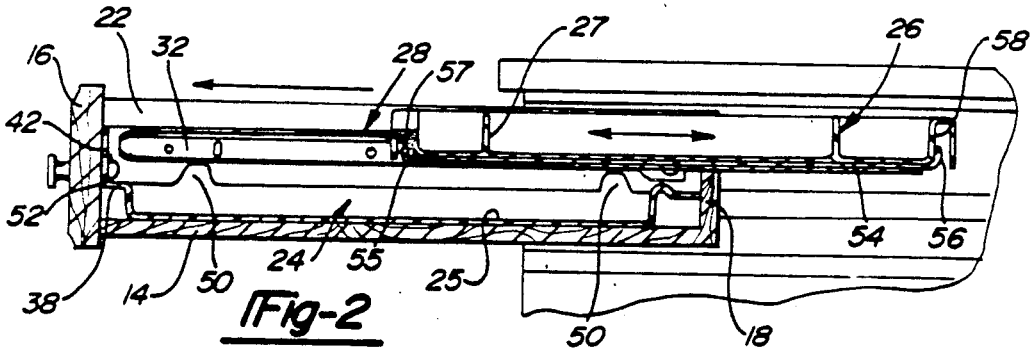
FIG. 2 is a cross-sectional view taken along the line 2—2 in FIG. 1.
Figure 3:
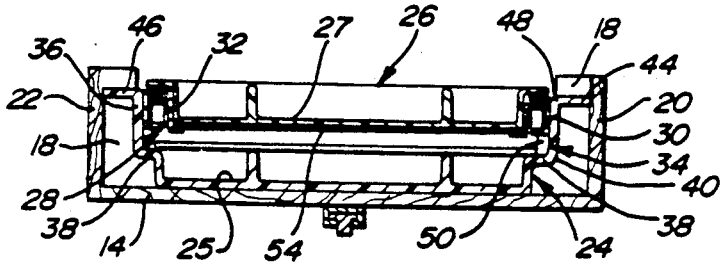
FIG. 3 is a cross-sectional view taken along the line 3—3 in FIG. 1.
Figure 4:
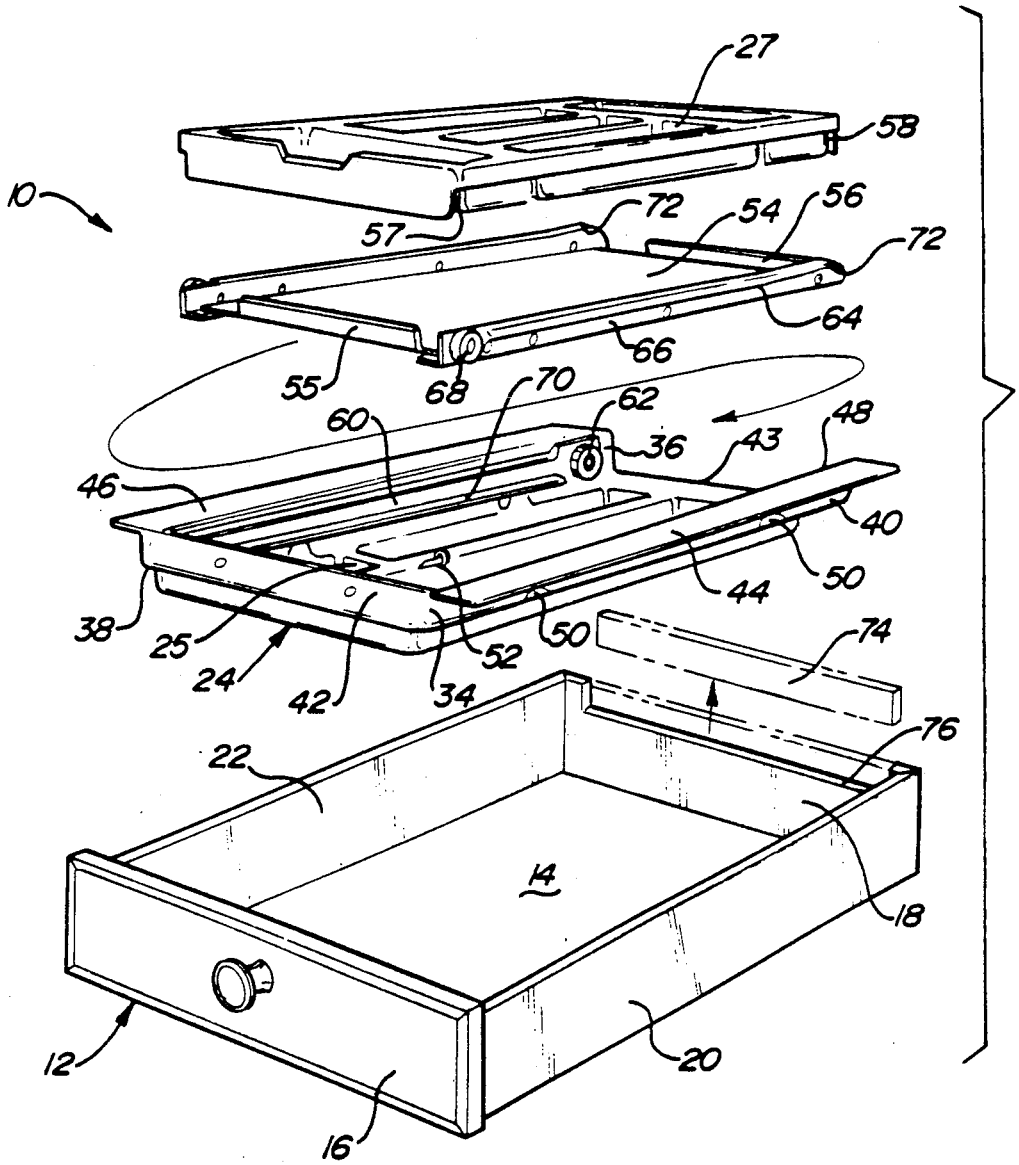
FIG. 4 is an exploded perspective view showing a modified drawer and the storage apparatus of the present invention.

Referring now to FIGS. 2 and 3, right and left roller track assemblies 30 and 32 are connected to a right and a left roller track mounting wall generally indicated by reference numerals 34 and 36 of the base tray 24. The mounting walls may be shaped in many different ways, however, the preferred shape is to provide a lip 38 extending horizontally from the lower compartmentalized storage section 25. The mounting walls 34 and 36 extend upwardly from the outer edge 40 of the lip 38. A front vertical wall 42 of the base tray 24 extends vertically upwardly from the lip 38 and is substantially parallel to the inside of the front wall 16. The rear edges of the mounting walls 34 and 36 and the rear edge of the lip 38 define an opening 43 through which the upper tray 26 is moved.

Right and left trim flanges, or lateral wings, 44 and 46 extend horizontally outwardly from the upper edge 48 of the right and left roller track mounting walls 34 and 36 which are secured to the right and left roller track mounting walls 34 and 36. Alternatively, the trim flanges 44 and 46 could have a downwardly extending wall (not shown) if it is desirable to provide a storage apparatus which is not cut to fit to the drawer sides. The roller track assemblies 30 and 32 are located vertically on the mounting walls 34 and 36 by seats 50 integrally molded into the mounting walls. The front vertical wall 42 is secured to the front wall 16 by means of fasteners 52. Alternatively, the base tray 24 could be glued or secured to the bottom 14 of the drawer 12. With either type of fastening means, it is important that the base tray 24 is held securely so that it does not move when the upper tray 26 is opened by the force of opening or the cantilever forces.

The upper tray 26 includes a detachable upper compartmentalized storage section 27 which is detachably secured to a support panel 54. The support panel 54 is a planar member having front and rear flanges 55 and 56 which are upwardly extending members that are received in front and rear recesses 57 and 58 of the compartmentalized storage section 27. The upper compartmentalized storage section is detachable from the support panel 54 so that it can be used as a tray or may be removed for cleaning. The detachable construction also simplifies molding and assembly processes required to manufacture the storage apparatus 10.

Base tray channels 60 form one-half of the roller track assemblies 30 and 32 and are secured to the right and left roller track mounting walls 34 and 36. The base tray channels 60 include a bearing member 62 disposed at the rear end thereof. A roller engaging surface 64 is formed on upper tray channels 66 at the upper edge thereof. The upper tray channels 66 are secured to opposite lateral sides of the support panel 54. Upper tray channels are preferably L-shaped to permit attachment to the planar surface of the support panel 54. The upper tray channels 66 include bearing members 68 at the front end thereof which ride upon roller engaging surface 70 formed at the lower end of the base tray channels 60.

A raised portion 72 formed on the rear end of each upper tray channel 66 biases the upper tray 26 into its forward position when the drawer 12 is opened. The raised portion 72 lowers the rear end of the upper tray 26 slightly when the upper tray 26 is in its closed position. When it is desirable to shift the upper tray 26 into its open position in which it is cantilevered rearwardly from the base tray 24, the roller engaging surface 64 is rolled up over the bearing member 62 to lift the rear end of the upper tray slightly.

To allow for rearward shifting of the upper tray 26, a cutout 74 is removed from the rear wall 18 to form an opening 76 through which the upper tray 26 may partially pass to provide access to the base tray 24.

The method of the present invention is one which is simplified so that only readily available household tools are required for assembly. The drawer 16 is modified by the removal of the cutout 74 to form the opening 76 in the rear wall 18. No other structural modification must be made in the drawer and the removal of the cutout 72 may be accomplished by a power or hand saw. The base tray can then be fitted to the drawer by trimming the trim flanges 44 and 46 to the space provided between right and left side walls 20 and 22. Right and left trim flanges 44 and 46 are easily cut by a hand or with a power saw after marking to the interior dimension of the drawer.

The base tray 24 is then inserted into the drawer 12 and fastened by fasteners 52 which secure the front vertical wall 42 of the base tray to the front wall 16 of the drawer 12. The upper tray 26 is installed by inserting the bearing member 68 of the upper tray channel 66 into the base tray channel 60. The detachable upper compartmentalized storage section 27 is then placed on the support panel 54 with the front and rear flanges 55 and 56 being received in the front and rear recesses 57 and 58. Some interference fit is desirable between the front and rear flanges and the front and rear recesses so that the upper compartmentalized storage section is firmly secured to the support panel 54.

Figure 5:
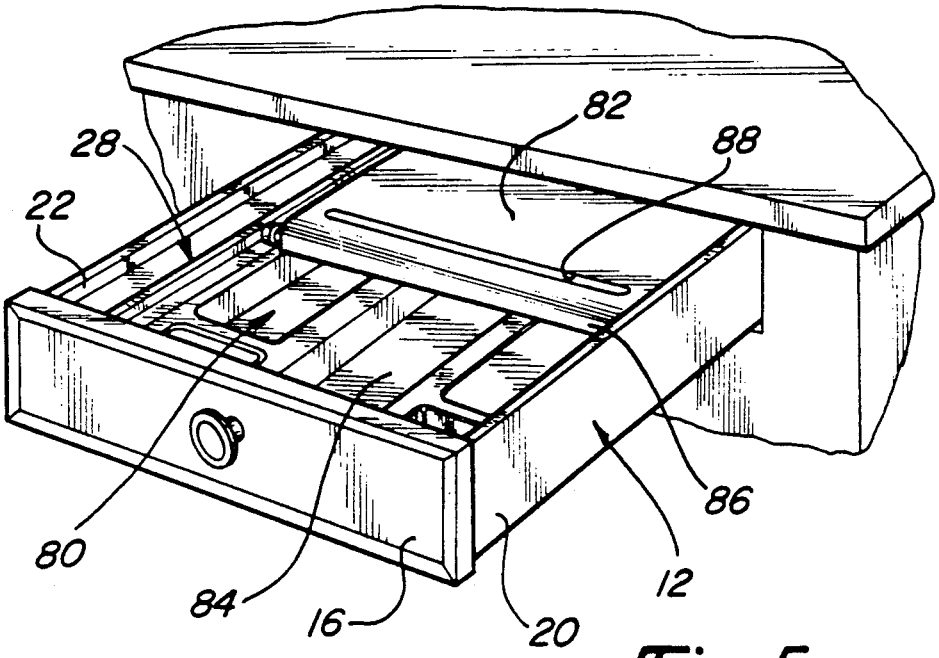
FIG. 5 is a perspective view of a drawer retrofitted with the storage apparatus including a cutting board in accordance with an alterative embodiment of the present invention.
Figure 6:
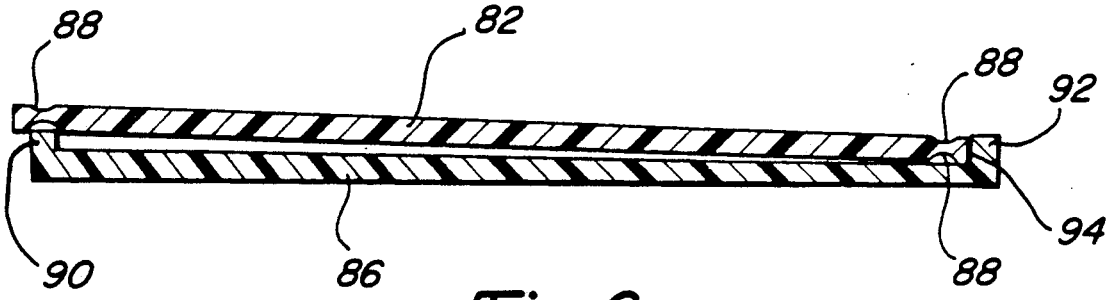
FIG. 6 is a cross-sectional view of the cutting board and support panel showing the cutting board stored on the support panel.

Referring now to FIGS. 5 and 6, an alternative storage apparatus 80 is shown for removably storing a cutting board 82 above a compartmentalized cutlery tray 84. The cutting board 82 rides on a support panel 86 which is similar in construction to the support panel 56 of the storage apparatus 10 previously described.

The cutting board 82 is preferably formed from ½ thick polyethylene sheet. Polyethylene is a preferred material due to its toughness and the ease with which it can be cleaned, for instance, by placing it in a dishwasher. The cutting board 82 includes gravy grooves which also serve as finger grooves 88 on its upper and lower surfaces near the front and rear edges of the cutting board 82. The finger grooves 88 may be molded into the polyethylene board or are preferably formed by a material removal tool such as a router. The finger grooves facilitate grasping the cutting board. The finger grooves also function to reduce the tendency of the cutting board to shift rearwardly or forwardly. A front flange 90 of the support panel 86 is received in the finger groove 88 formed on the lower surface of the front portion of the cutting board 82 when the cutting board 82 is properly stored on the support panel 86. A rear flange 92 of the support panel 86 abuts the rear edge 94 of the cutting board 82 which prevents the cutting board from sliding behind the storage apparatus 80. The cutting board is intended to be detachably retained on top of the support panel 86 on a slight angle which allows the cutting board to be easily removed from the drawer.

The preceding description of the present invention is of a preferred embodiment and is not to be construed in a limiting sense. Many modifications may be made in the structure of the invention without departing from the spirit and scope of the present invention as claimed in the following claims.

I claim:

1. A method of retrofitting a drawer with a two-tiered storage apparatus, said drawer having a bottom wall, a front wall, a rear wall and two sidewalls, said method comprising:

removing at least an upper portion of the rear wall of the drawer to form an opening in the rear wall;

providing a base tray and an upper tray;

providing a guide means with a shiftable part and a stationary part;

placing said base tray in said drawer;

mounting said stationary part of said guide means in said drawer;

providing said shiftable part of said guide means on said upper tray; and attaching said shiftable part to said stationary part, such that said upper tray is horizontally shiftable between a closed position and an open position wherein said upper tray is partially extended through the opening in the rear wall of the drawer and cantilevered over said rear wall.

2. The method of claim 1, further comprising attaching a detachable cutting board to the upper tray to be shiftable therewith or removed from the upper tray for use as a cutting board separate from the upper tray.

3. The method of claim 2 wherein said cutting board includes a groove which receives a flange of the upper tray to prevent sliding displacement of the cutting board relative to the upper tray during horizontal shifting movement of the upper tray.

4. The method of claim 2 wherein said upper tray includes a flange at its rear edge which engages an edge of the cutting board to prevent sliding movement of the cutting board during horizontal shifting of the upper tray.

5. The method of claim 3 wherein said upper tray includes a flange at its rear edge which engages an edge of the cutting board to prevent sliding movement of the cutting board during horizontal shifting of the upper tray.

* * * * *